US005809728A

United States Patent [19]

Tremelling

[11] Patent Number: 5,809,728

[45] Date of Patent: Sep. 22, 1998

[54] SELF-SUPPORTING CONCRETE FORM MODULE

[75] Inventor: Tim Cyril Tremelling, Rigby, Id.

[73] Assignee: Innovative Construction Technologies Corporation, Idaho Falls, Id.

[21] Appl. No.: 874,840

[22] Filed: Jun. 13, 1997

Related U.S. Application Data

[62] Division of Ser. No. 568,744, Dec. 7, 1995, Pat. No. 5,701,710.

[51] Int. Cl.[6] ..... E04C 1/41; E04B 2/86

[52] U.S. Cl. ..... 52/426; 52/563; 52/565; 52/699; 52/713

[58] Field of Search ..... 52/426, 565, 563, 52/699, 713, 714

[56] References Cited

U.S. PATENT DOCUMENTS

| | | | |
|---|---|---|---|
| 3,552,076 | 1/1971 | Gregori . | |
| 3,788,020 | 1/1974 | Gregori . | |
| 4,223,501 | 9/1980 | DeLozier . | |
| 4,765,109 | 8/1988 | Boeshart | 52/426 |
| 4,879,855 | 11/1989 | Berrenberg . | |
| 4,884,382 | 12/1989 | Horobin | 52/426 |
| 4,894,969 | 1/1990 | Horobin . | |
| 5,065,561 | 11/1991 | Mason | 52/426 X |
| 5,459,971 | 10/1995 | Sparkman | 52/565 X |

*Primary Examiner*—Christopher Kent

*Attorney, Agent, or Firm*—Fitch, Even, Tabin & Flannery

[57] ABSTRACT

A free standing form module for receiving flowable materials includes a pair of form members, preferably made of styrofoam, joined together by molded plastic rib members. The rib members may be monolithic or formed from plural components. Bearing plates and stabilizing plates are employed to support forces applied to the form module.

5 Claims, 11 Drawing Sheets

SELF-SUPPORTING CONCRETE FORM MODULE

This is a division of U.S. Pat. application Ser. No. 08/568,744 filed Dec. 7, 1995.Now U.S. Pat. N0. 5,701,710

BACKGROUND OF THE INVENTION

1. Field of the Invention:

The present invention pertains to forms such as concrete building forms which are self-supporting and which are modular in design so as to be stacked one on top of another to form a wall of desired size.

2. Description of the Related Art:

Various forming systems have been proposed for poured structures such as concrete walls. These systems are employed to hold the wet concrete in place until the concrete "sets" or is cured. Recently, foam forming systems have been proposed to replace older forms made of plywood, metal or wood frame materials or the like. The foam concrete form systems which have been proposed promise advantages of improved overall thermal insulation, the elimination of thermally conductive thermal bridges, the elimination of tie wires, tie rods and the like labor intensive components.

These foam forms are typically made of an expanded polymeric material such as polyurethane or polystyrene. The materials are expanded within a mold to produce low-density foamed plastic form components. The components typically comprise opposed wall portions which define concrete-receiving cavities therebetween. The foamed wall portions are held together by a variety of materials, including sheet metal, expanded metal and molded plastic members. Examples of foamed concrete form systems are given in U.S. Pat. Nos. 3,552,076; 4,894,969; 3,788,020; 4,879,855; and 4,223,501.

The use of foamed forming components has been widely adopted for construction in the United States since the late 1980's. These forms are employed in the construction of above-grade as well as below-grade concrete walls, of the load bearing and non-load bearing type, for residential and commercial buildings. The goal is to employ the concrete forms as permanent components of a building structure and to avoid the use of additional forms or supports for the foam form systems. The foam wall portions of the forms add insulation value to the poured concrete and, if constructed properly, can provide a higher insulation value than conventional stud walls with fiberglass insulation. Use of foamed concrete forms has been found to result in reduced labor investment, due in part because the forming systems are lightweight and easily maneuvered on a job site. Further, in inclement weather, the foamed concrete forms provide improved concrete curing conditions and are now relied upon to extend the construction season. In addition, the resulting wall structures are resistant to termite and other insect infestations and provide improved fire safety for the ultimate occupants of the buildings.

Of course, many of the advantages of the foam concrete form systems are lost if they cannot be routinely relied upon to sustain loadings during a pour. Care must be taken to avoid blowout and floating or walking of the forms while pouring concrete. The rate of pour of concrete is carefully controlled, typically on the order of four feet of wall height per hour. Once the concrete within the form begins to set, stresses experienced by the foam systems begin to relax.

Despite the advantages of known foam concrete form systems, improvements are still being sought. For example, many of the foam concrete forms require extensive user training to address problems of blowout and floating or walking of the forms during a concrete pour. Many of the foam forms require considerable additional bracing, and/or require commercially disadvantageous slow pour rates. Even when containment of the poured medium is not breached, foam concrete forms are known to undergo movement, such as walking or floating as well as distortion and bulging, during a concrete pour. Some forms lack an adequate number of attachment members or the attachment members provided in a concrete form system are inadequate. For example, composition of the attachment members can provide a thermally conductive path for energy transfer through a wall.

Typically, attachment members are not continuous throughout a concrete-forming system, but rather are discontinuous and spaced apart. Accordingly, they must be targeted for location after the concrete is poured and erection of the wall is completed. At times, the attachment members are too small or difficult to locate, or may exhibit stripout or loosening of fasteners secured to the attachment members.

In order to address these problems, some foam concrete form systems have required the use of limited availability special self-tapping anchors, and some anchors require expensive additional reinforcement and attachment strips to support common materials applied to a formed wall. Typically, the use of adhesive is prohibited. Fastener members which require metal tension members commonly undergo bending or distortion leading to misaligned sidewalls.

Further, certain advantages can be attained, such as reduced special training for skilled trades, if the structural characteristics of different components of a concrete form are not widely dissimilar. For example, some foam form systems employ both expanded foam and steel reinforcing bars (rebars). During erection of a wall system, these two widely different materials must be handled in different ways. For example, the internal steel members can resist substantial heat loads associated with grinding, for example, whereas the expanded foam components are readily damaged in these same environments, even with inadvertent contact.

As another example, the tie wires used to connect internal steel bracing members within a wall system are relatively rugged and require hand tools to form and cut the wires. If these hand tools should slip, substantial injury to the expanded foam components could result. While these problems may seem unimportant to those who are unfamiliar with the building trades, such problems can take on an important significance under continuously changing conditions of various construction deadlines, inclement weather, mixed work crews having different construction experience as well as the congested nature of a building site where various trades are in close contact with one another and with the building components being handled. For example, some of the building trades may be unfamiliar with the relatively delicate nature of the expanded foam concrete form systems employed at a job site.

SUMMARY OF THE INVENTION

It is an object of the present invention to provide foam concrete forms for use in conventional buildings.

A further object of the present invention is to provide foam concrete form systems of both fixed width and variable width types.

A further object of the present invention is to provide a foam concrete form system having improved strength, yet which is flexible in its application so that the same form can be used on either side of a building wall.

Yet another object of the present invention is to provide foam concrete form systems which can be constructed from a number of different materials to provide different optimum operating characteristics.

These and other objects of the present invention are provided in a freestanding form module for receiving flowable materials to make a wall which includes the form module, the form module comprising:

at least two spaced-apart form members having opposed interior form surfaces, each form member including a wall portion and a rib portion extending from the wall portion toward the other form member; and at least one tie member having opposed ends with a web member between the ends extending along a web axis, a bearing member at each end of the tie member, extending generally transverse to the web axis and embedded in a respective form member and each end of the tie member having a stabilizing member extending generally transverse to the web axis, spaced from the bearing member and embedded in the a respective form member adjacent the interior form surface thereof.

Certain characteristics of poured concrete were taken into account in designing the form modules of the present invention. For example, freshly placed concrete behaves, for a while, like a fluid, producing hydrostatic pressure that acts laterally on the vertically extending panels of the modules. If the rate of concrete pour is excessive (as for example in a mistaken attempt to too quickly attain a full wall height) before the concrete is allowed an initial set, lateral pressure experienced by the concrete forms may be comparable to that exerted by a full liquid head. When the concrete is placed at a slower rate, the concrete at the bottom of the form begins to set and thus stops exerting lateral pressure on the form. However, this is not a simple situation, since the effective lateral pressure exerted by concrete is found to be influenced by several factors, including the weight and temperature of the concrete mix, the rate of placement of the concrete, the use of admixtures in the concrete being poured, and the effect of vibration or other methods of consolidating the poured concrete material.

The weight of concrete has a direct influence on the lateral pressure on the form. When the concrete acts as a true liquid, the lateral pressure exerted by the concrete would be equal to the density of the concrete multiplied by the depth at which the pressure is being considered. However, in reality, concrete comprises a mixture of solids and water whose behavior approximates that of a true liquid only for a limited time. The temperature of the concrete at the time of pouring plays an important role in the calculation of lateral pressure, since the temperature affects the setting time of the concrete. At low temperatures, the concrete takes a longer time to set, and therefore, for a given flow rate, forms employed in the present invention will experience a higher lateral pressure from concrete at low temperature than at a higher temperature. The average rate of rise of concrete in a form is typically referred to as the "rate of placing," and is particularly important because of its primary effect on lateral pressure exerted on the concrete forms. Additional lateral loads are transmitted to the concrete forms during attempts at consolidating the concrete using internal vibration, tamping, or other techniques.

The above conditions help to explain unexpected failures of previous foam concrete form systems, and highlight the need for foam concrete form systems of adequate strength to withstand the above varying conditions, as well as inadvertent mistakes. For example, equipment malfunction or operator inattention may lead to a brief surge in the pouring or placing of the concrete. Even a modest surge can quickly expose the foam concrete forms to excessive lateral loads, not anticipated by the foam form designer. However, with concrete forms according to the present invention, an increased safety factor is employed so as to successfully withstand many types of inadvertent errors during building construction. Indeed, concrete forms according to the present invention exhibited remarkable strength, allowing maximum pour rates which could be achieved by conventional concrete work crews, without regard to limiting the pour rate as was heretofore necessary.

DETAILED DESCRIPTION OF THE PREFERRED EMBODIMENTS

The present invention provides different types of self-supporting foam form modules, preferably with alternating tongue-and-groove interlocking edges that allow the modules to be interlocked to form a wall. The form modules have a plurality of substantially cylindrical vertical and horizontal cavities or cells which receive concrete or other flowable materials during a pour and which aid in distributing the poured materials throughout a form system erected for a wall of a desired size. The form modules of the present invention can be utilized both above grade as well as below grade and be locked in place to provide benefits of added insulation as well as a system for attaching surface coatings, panels and other materials. In addition, the form modules provide internal means for engaging threaded fasteners, nails and all standard construction anchors which penetrate into the modules making up a wall-forming system.

As will be seen, form modules according to the present invention are preferably formed of relatively dense (i.e., 2 lb. per square foot) expanded polystyrene, non-metallic insulating material and have the general shape of a right rectangular parallel-piped with parallel sidewalls joined by integral ribs and non-metallic tie members preferably constructed of ABS or PVC plastics.

Turning now to the drawings, and initially to FIGS. 7–12, a foam-form or form module is generally indicated at 10. The form module 10 includes a pair of opposed, spaced-apart form members or wall panels 12, 14 defining a hollow interior space therebetween for receiving a variety of materials, such as settable building materials, (i.e., cementitious materials, and most preferably concrete mixtures) and nonsettable materials, such as sand. The modules could also be used to hold earth, crushed rock, or even radiation shielding materials. As will be seen herein, the panels 12, 14 are held together by a plurality of tie members.

Figure 1:
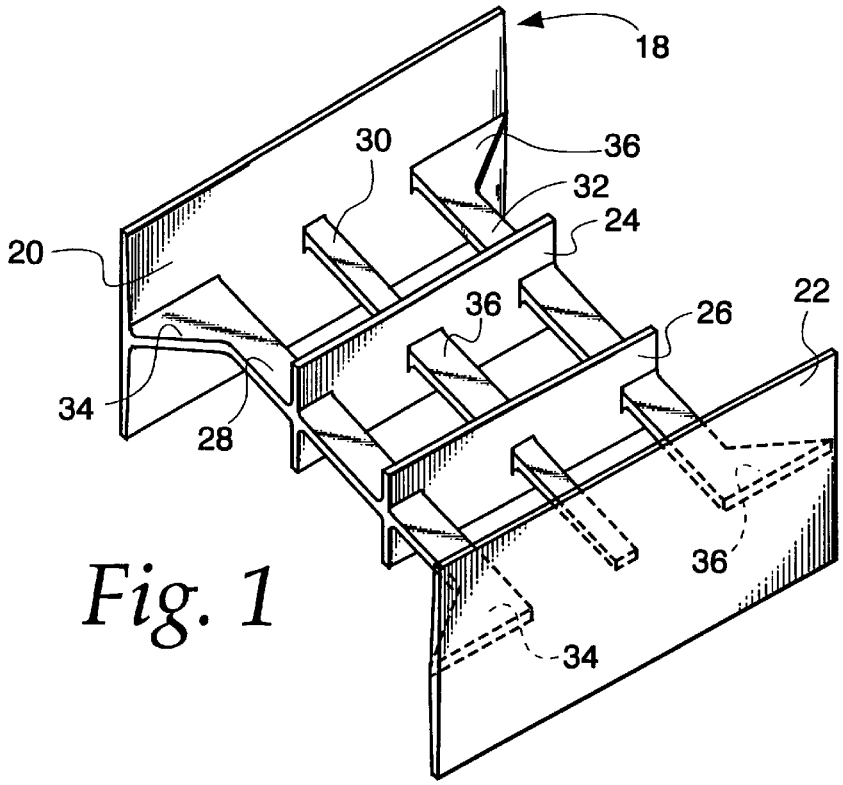
FIG. 1 is a perspective view of a tie for use in a form module, according to principles of the present invention.
Figure 2A:
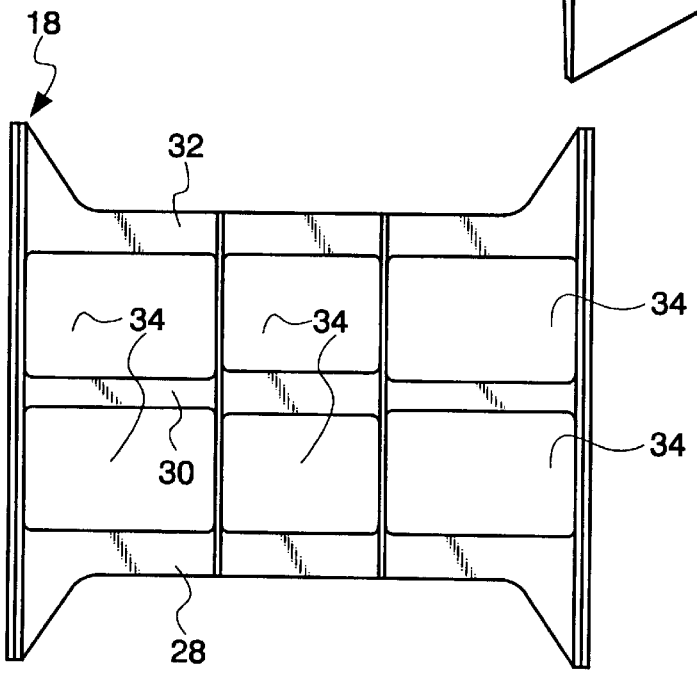
FIG. 2*a* is a front elevational view thereof.
Figure 3:
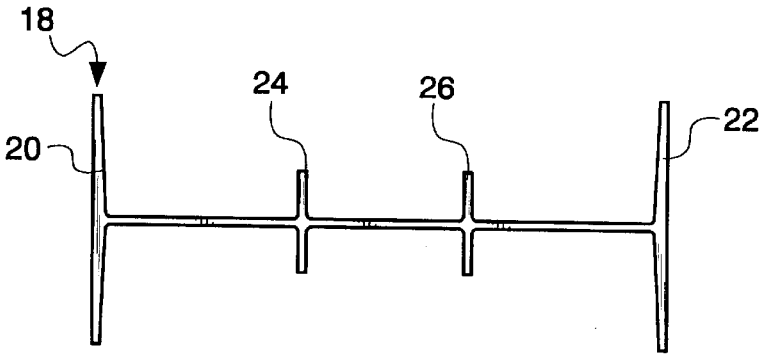
FIG. 3 is a top plan view thereof.

Referring to FIGS. 1–3, a first example of a tie member is generally indicated at 18. Tie member 18, located in the interior portions of the form module, is preferably formed of a one-piece (monolithic) structure of a nonmetallic material, such as a molded plastic material. In the preferred embodiment, tie member 18 is made of an acrylonitrile butadiene styrene (ABS) type of compound, and most preferably is made of compound number Magnum 9555 available from Dow Chemical Company.

Tie member 18 is double ended, and includes bearing plates 20, 22 at its ends. A pair of spaced-apart stabilizing members or plates 24, 26 are located between the bearing plates and preferably have a smaller size. A web member extends between the bearing plates 20, 22 along a web axis. The web member is preferably comprised of three spaced-apart elongated strip portions 28, 30 and 32 which extend between the bearing plates, being connected to the stabilizing plates 24, 26, as well as the bearing plates. The strip portions are each comprised of three web parts joined end-to-end in a series. In the preferred embodiment, the web axis extends at right angles to the planes of the bearing plates and the stabilizing plates. Hence the bearing plates and stabilizing plates are parallel to one another. As can be seen, the central portion of tie member 18 is foraminous, having a series of apertures 34 through which concrete material can freely flow to fill up the form module during a pour.

Preferably, the bearing plates and stabilizing plates have a relatively small thickness compared to their major surface areas, and generally rectangular major surface areas, although other configurations are also possible. The stabilizing plates are shorter in height than the bearing plates and preferably have a width ranging between 35% and 50% of the bearing plate width (see FIG. 3).

Figure 11:
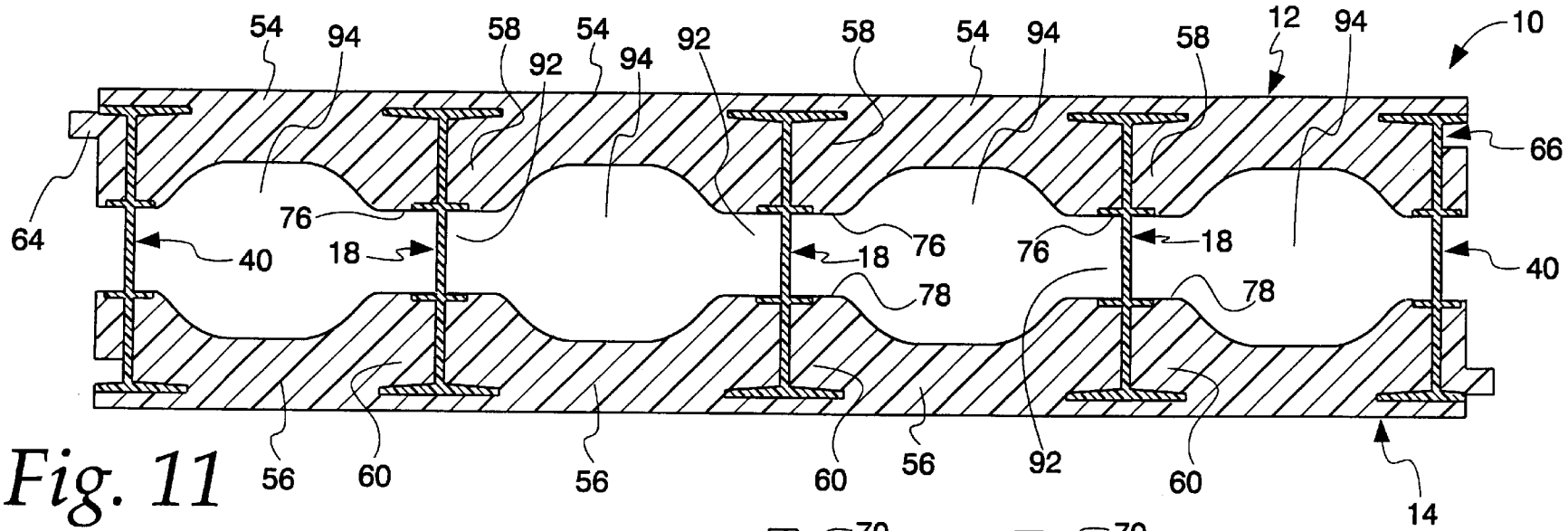
FIG. 11 is a cross-sectional view taken along the line 11—11 of FIG. 8.

With brief reference to FIG. 11, a cross-sectional view of a completed form module is shown. In use, the form module is filled with a pourable material such as concrete, which is subsequently allowed to harden. As will be seen herein, the tie members have their ends embedded in foam panels, with the exposed major surfaces of the foam panels becoming exposed surfaces of a building wall, for example. Paneling, plasterboard or other wall treatments can be applied to the wall structure. The tie members, and particularly the bearing plates, are adapted to receive virtually any conventional fastener in use today. For example, screws or nails, including pneumatically-driven nails, can be employed to secure objects to a wall. The fasteners penetrate the bearing plate to effect a retaining engagement therewith. For example, screws and other threaded devices will have a conventional threaded engagement with the bearing plates. Nails, such as pneumatically-driven nails, penetrate the bearing plates in a conventional manner. However, it has been found that the bearing plates offer an additional advantage not found with other construction practices. In particular, a localized melting or softening of the bearing plates has been observed at the point of penetration, presumably caused by friction of the fastener member entering the bearing plate. In any event, an increased securement, resembling an adhesive securement, has been observed between the fastener and the tie member.

Figure 2C:
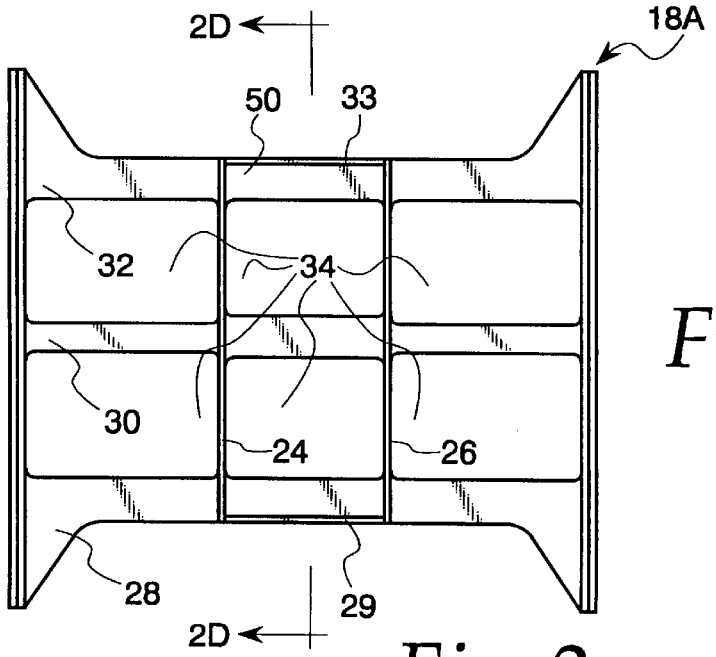
FIG. 2*c* is a front elevational view of an alternative tie member.
Figure 2D:
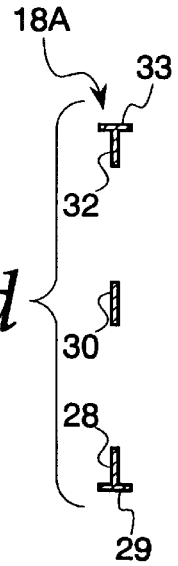
FIG. 2*d* is a fragmentary cross-sectional view taken along the line 2*d*—2*d* of FIG. 2*c*.
Figure 2E:
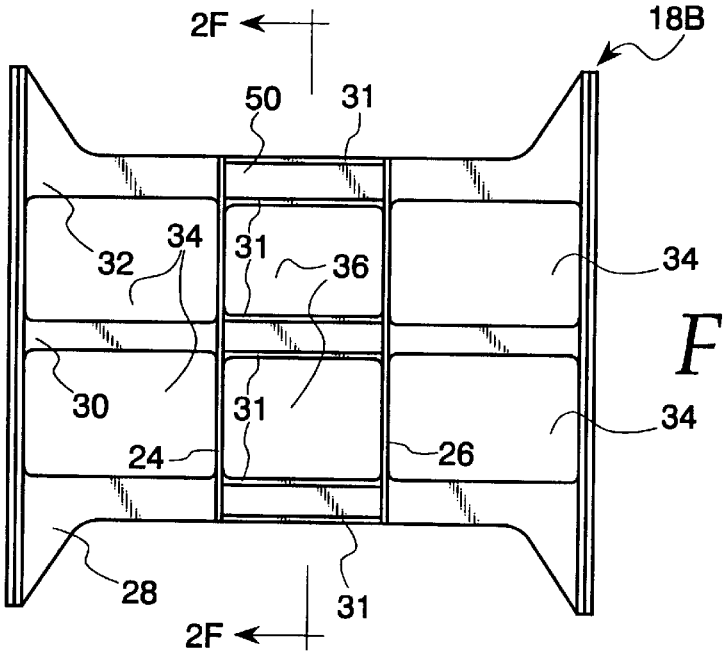
FIG. 2*e* is a front elevational view of a further alternative tie member.
Figure 2F:
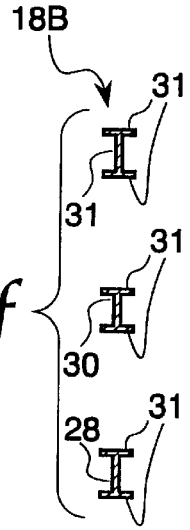
FIG. 2*f* is a cross-sectional view taken along the line 2*f*—2*f* of FIG. 2*e*.
Figure 2B:
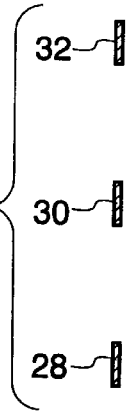
FIG. 2*b* is a cross-sectional view taken along the line 2*b*—2*b* of FIG. 2*a*.

Referring to FIGS. 2*a* and 2*b*, the nine web parts which make up the strip portions 28, 30 and 32 have a generally rectangular plate-like configuration, with a thickness much smaller than that of their major surface areas. The outermost strip portions 28, 32 have generally triangular enlargements 34, 36 at their ends. As can be seen in FIG. 3, the bearing plates 20, 22 are preferably provided with a triangular cross section portion having slightly increasing thickness portions in their central regions, and with a maximum thickness at their point of joinder with the strip portions. As can be seen in FIGS. 2*a* and 2*b*, the strip portions 28, 30 and 32 have generally constant cross sections throughout their length, except that the central portion 36 of strip portion 30 is slightly larger than the remaining outer end portions of strip portion 30.

FIG. 2*b* shows a fragmentary cross-sectional view of the central web parts of tie member 18. As can be seen, the central web parts (i.e., those web parts extending between the stabilizing plates 24, 26) have a generally rectangular cross section, with the web parts resembling flat strips. If additional support is required, the additional support provided by tie members 18*a*, 18*b* can be employed. These alternative tie members are shown in FIGS. 2*c*—2*f*.

Turning now to FIGS. 2*c* and 2*d*, tie member 18*a* is generally identical to the aforedescribed tie member 18 except for the addition of strengthening members 29, 33, which have been added to the central web parts of strip portions 28, 32, respectively. As can be seen in FIG. 2*d*, the central web parts of strip portions 28, 32 have a generally T-shaped cross section. As will be seen herein, the central web parts of tie member 18*a* (i.e., those web parts extending between stabilizing plates 24, 26) are exposed, whereas the end web parts (those web parts lying outside of the stabilizing plates 24, 26) are embedded in a styrofoam member. The strengthening members 29, 33 prevent a sideways bowing or the like distortion of the tie member illustrated in FIG. 2*d*.

If additional strengthening is required, tie member 18*b* can be employed, with strengthening members 31 applied to the central web parts. As indicated in FIGS. 2*e* and 2*f*, each central web part receives a pair of strengthening members 31, resulting in a cross section which is generally I-shaped. If desired, it may be possible to eliminate the strengthening members 31 from the central web part. In any event, the strengthening members 29 or 33, described above, or strengthening members 31, described herein, preferably extend between the stabilizing plates 24, 26 to provide an increased lateral rigidity and strength.

Figure 4:
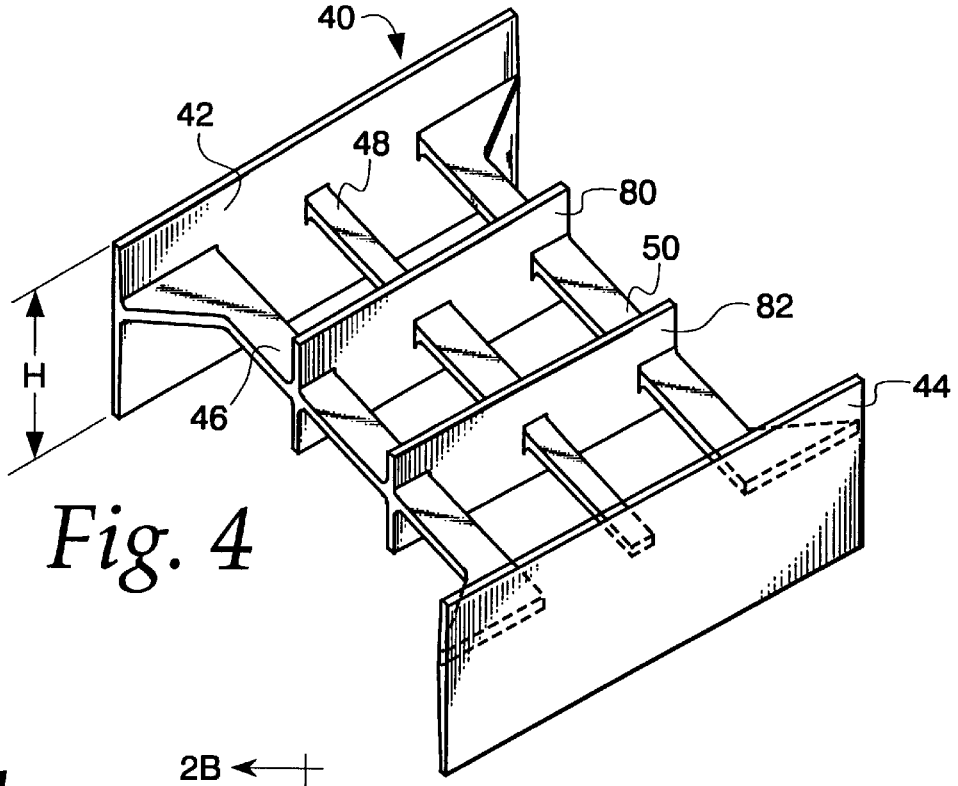
FIG. 4 is a perspective view of an alternative design of a tie member, according to principles of the present invention.
Figure 5:
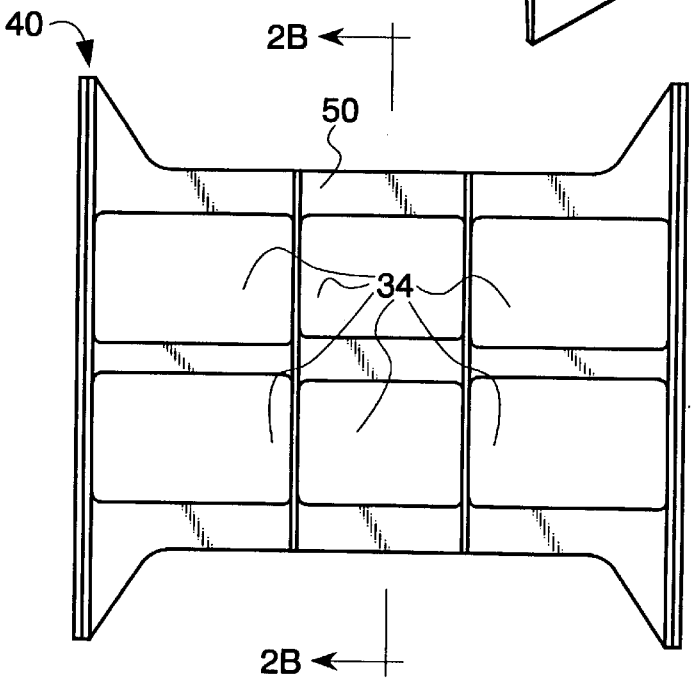
FIG. 5 is a front elevational view thereof.
Figure 6:
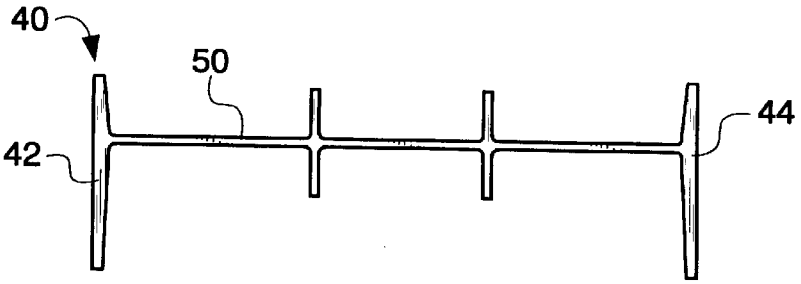
FIG. 6 is a top plan view thereof.

Referring again to FIGS. 7–12, form module 10 further includes end or exterior tie members 40, located at either end of the form module. The exterior tie members 40 are shown in greater detail in FIGS. 4–6 and, by comparison, their close resemblance with internal tie member 18 can be readily observed. One difference between the tie members 40 and 18 is that the bearing plates 42, 44 have a reduced dimension H compared to the height of the bearing plates 20, 22. By comparing FIGS. 2 and 5, it can be seen that the interior and exterior tie members 18, 40 are both symmetrical about vertical and horizontal centerlines extending through those views. However, by comparing FIGS. 3 and 6, it can be seen that the interior tie member 18 is symmetric about vertical and horizontal centerlines extending through that Figure, whereas the exterior tie member 40 as shown in FIG. 6 is symmetric only about a vertical centerline, and is not symmetrical about a horizontal centerline extending through that Figure. The strip portions 46, 48, 50 of tie member 40 closely resemble the strip portions 28, 30 and 32 of tie member 18, in form and appearance.

Referring to FIG. 6, that portion of the bearing plates 42, 44 extending above strip portion 50 generally resembles the portion of the bearing plates extending below the strip portion, except that the upper portions are truncated. It is generally preferred that the strip portion 40 be substantially similar to the tie members 18, except for the truncation of the bearing plates 42, 44 in the view shown in FIG. 6. Since the stresses on the end tie member 40 differ from the stresses borne by the internal tie member 18, the relative thicknesses, material composition and shapes of the end tie members 40 can be varied to accommodate the increased loadings borne by the end tie members This, however, has not been found to be necessary, and economies of construction of the equipment used to fabricate the tie members 18, 40 have been enjoyed without impairing the satisfactory performance of the resulting form module.

Referring to FIGS. 7–12, the internal and external tie members 18, 40 extend between panels 12, 14, as noted above. Preferably, the panels 12, 14 comprise mirror images of one another. The panels 12, 14 are preferably monolithic, made of a foam material, most preferably confirming to ASTM C578-87A type IX with a density of at least two pounds per cubic foot. Referring to FIG. 11, panels 12, 14 have wall portions 54, 56 of relatively reduced thickness, and rib portions 58, 60 of increased thickness. The ribs 58, for example, extend from wall portions 54 toward panel 14. Likewise, the ribs 60 of panel 14 extend from wall portion 56 toward panel 12.

As can be seen in FIG. 11, for example, the ribs 58, 60 of the panels are continuously blended, having reduced thicknesses at their upper and lower ends adjacent the ribs 70 and the grooves 72.

The rib portions of each wall panel are arranged in a spaced-apart series along the length of the wall panel, and-preferably the ribs are arranged directly opposite one another in the form module 10. The ribs are preferably continuously smoothly blended with the wall portions, and sharp corners are eliminated to reduce stress concentrations on the monolithic foam structures.

Figure 7:
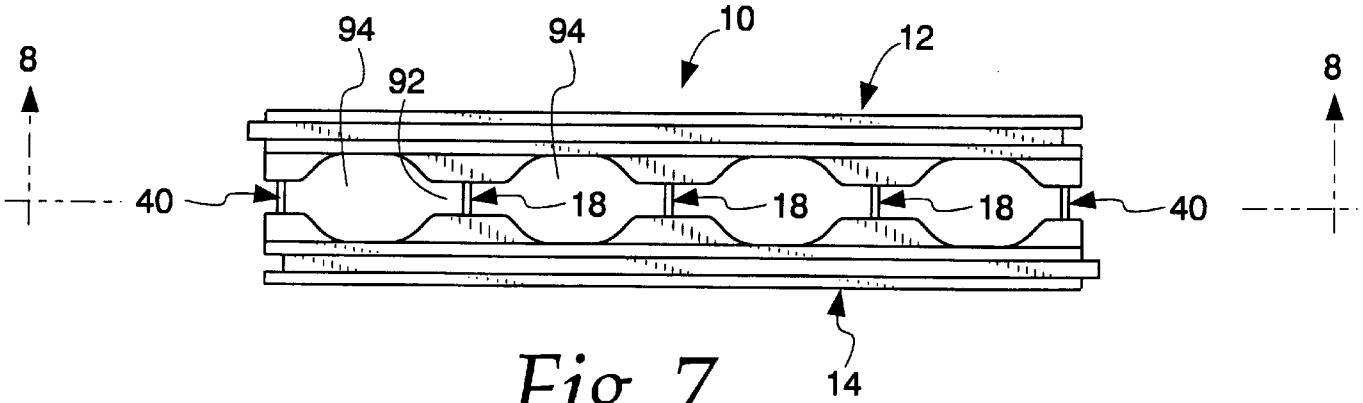
FIG. 7 is a top plan view of a form module utilizing the ties of the preceding Figures.
Figure 8:
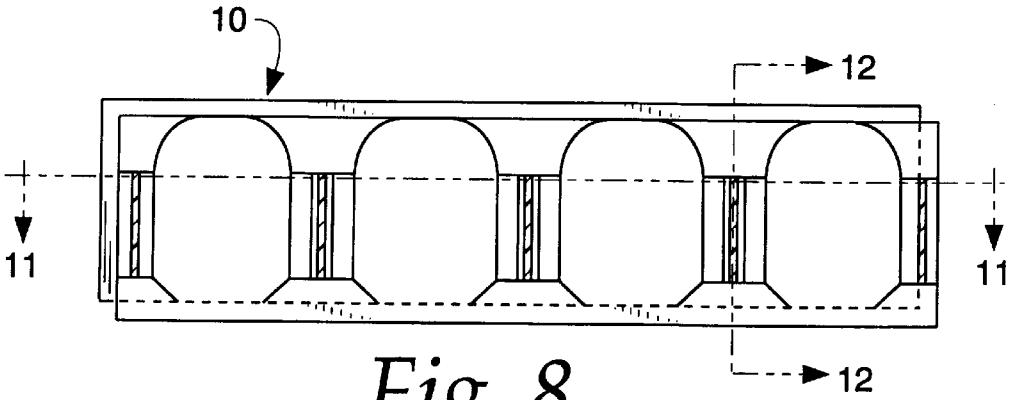
FIG. 8 is a front elevational view thereof.
Figure 9:
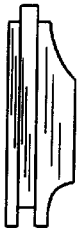
FIG. 9 is an elevational view from one end thereof.
Figure 10:
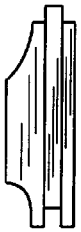
FIG. 10 is an elevational view from the other end thereof.
Figure 12:
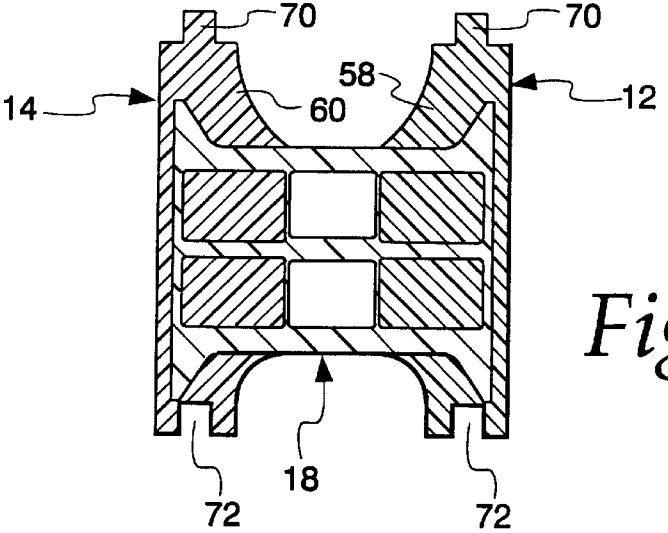
FIG. 12 is a cross-sectional view taken along the line 12—12 of FIG. 8.
Figure 16:
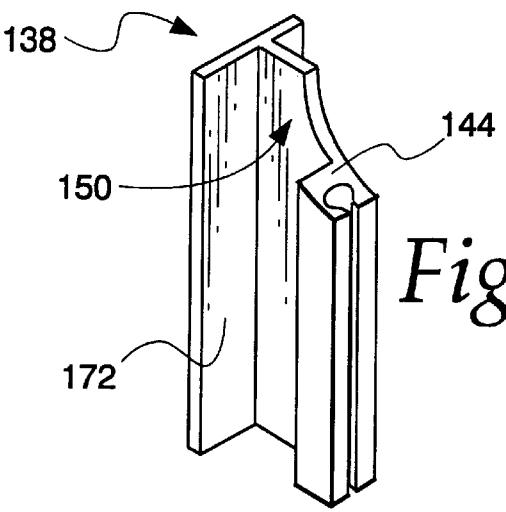
FIG. 16 is a further tie component used in the alternative embodiment of the present invention.
Figure 17:
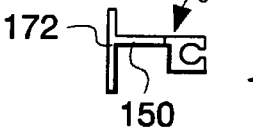
FIG. 17 is a top plan view thereof.
Figure 18:
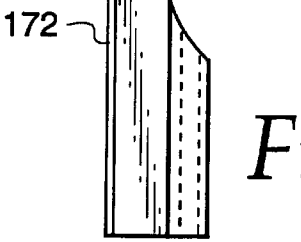
FIG. 18 is a front elevational view thereof.
Figure 13:
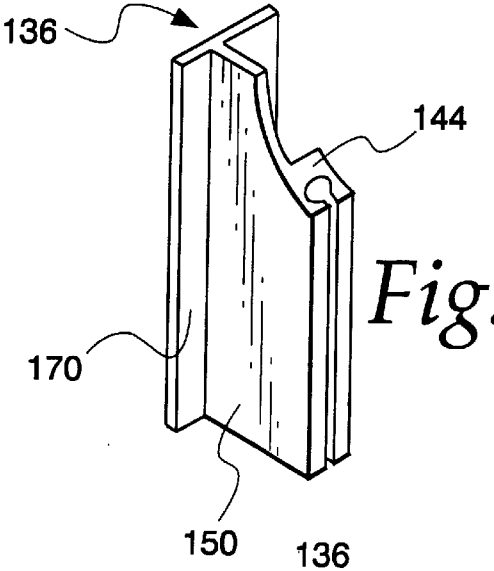
FIG. 13 is a perspective view of a tie component used in another embodiment of the present invention.
Figure 14:
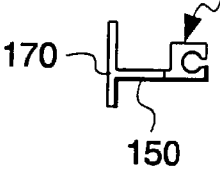
FIG. 14 is a top plan view thereof.
Figure 15:
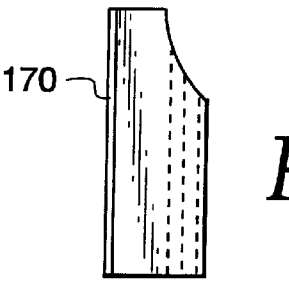
FIG. 15 is a front elevational view thereof.

As can be seen in FIGS. 7 and 11, for example, the ends of the form module 10 preferably include a staggered tongue-and-groove construction. The form module 10 is thus adapted for side-by-side joinder with like neighboring modules so as to cooperate therewith to establish a continuous horizontally extending form system. Further, with reference to FIGS. 9, 10 and 12, tongue-and-groove members are formed at the top and bottom ends of form module 10. Referring to FIG. 12, tongue members 70 extend from the upper end of the panels 12, 14, whereas grooves 72 are formed in the lower ends of the panels.

As can be seen for example in FIGS. 11 and 12, the bearing plates of the tie members 18, 40 are embedded within the respective panels 12, 14, located adjacent the exterior surfaces of those panels. The stabilizing walls 24, 26 are located adjacent the interior form surfaces of the panels, and preferably extend into the panels from the interior form surfaces 76, 78 (see FIG. 11) so as to be only partially embedded in the respective panels 12, 14. Referring to FIG. 11, it can be seen that the stabilizing plates 24, 26 are not as wide as the web surface portion of the ribs 58, 60.

The stabilizing plates 24, 26 of interior tie member 18 and the stabilizing plates 80, 82 of exterior tie member 40 maintain the spacing of the styrofoam walls during a pour, supporting the form module against the lateral forces of the concrete mixture. Further, if the form modules are used to construct a wall or other vertical structure, it is possible that items such as shelving and the like be attached to the wall for support. Although concrete fasteners could be employed, it is preferred that fasteners be secured to the bearing plates.

It is anticipated that at least a portion of the external load (e.g., shelf or cabinet) applied to the bearing plates will place the tie member in tension. Tension forces applied to one bearing plate will be applied through the web members to the stabilizing plates and to the opposing bearing plates. The stabilizing plates are secured in the concrete (or other building material) poured in the form module and thus force would be transmitted to the poured medium. Depending upon the distribution of forces imparted by the tie member, the bearing plate on the opposite side of the wall may also be drawn toward the poured medium, placing the styrofoam between the opposing bearing plate and the poured medium in compression.

Thus, the stabilizing plates cooperate with the bearing plates to support an external load applied after a structure, such as a building wall, is completed. As mentioned, the stabilizing plates hold the walls of the form module together during a pour. However, it is possible that the poured material will, on a momentary basis, not be uniformly distributed within the form module, and hence, an unbalanced net lateral force could be applied internally to the form module. In this instance, the stabilizing plates help support the tie members from pushing out of the styrofoam walls, causing the form module to fail.

As can be seen herein, it is important to note that the web members are placed in tension during various, different operating modes, i.e., during balanced pour conditions, unbalanced pour conditions, and post-setup wall attachment conditions. It is also important to note that the web members efficiently distribute the tension forces to the bearing plates and/or stabilizing plates. Accordingly, it is generally preferred that the web members be arranged so as to transmit tension forces to the entire height of the stabilizing plates and/or bearing plates. It is also generally preferred that the web member include multiple spaced-apart strip portions, each extending between the bearing plates, and each connected to the intermediate stabilizing plates.

As mentioned above, the tie members are preferably made of molded plastic material. As can be appreciated from the above, the tie members experience significant tensile forces of various types, throughout their operating life. Accordingly, it is generally preferred that the tie members have rounded corners wherever possible. However, the radius of rounding of the tie members is too small to be accurately shown in the drawings.

By using the three spaced-apart strip portions extending between the bearing plates, each strip portion can have a reduced surface area, allowing the spacing between adjacent strip portions to be increased. Further, the tie member is constrained against racking by employing three strip portions. As can be seen in FIG. 12, for example, the three strip portions are each, in a load-bearing sense, divided into three web parts by the stabilizing walls. Thus, rigidity and stability of the strip portions is increased, allowing the strip portions to be made of thinner material. Further, loads applied to the tie member are more uniformly distributed throughout, by employing the open matrix or rectilinear gridwork of web parts and stabilizing plates.

When used with a concrete or other flowable material, the primary function of the foam wall panels is to support the lateral pressure imparted by the wet concrete poured between the panels, until such time as the concrete can support itself. The thickness of the thinner portions of the panel cross section is governed by the bending capacity of that section, as well as the allowable deflection that can be tolerated without jeopardizing alignment of the overall wall system.

Thickness of the rib portion of the wall panel is governed by shear and bending capacities and also by the overall allowable deflection of the wall panel. The unsupported ends of the form modules undergo a higher amount of deflection and distortion than other parts of the forms because these ends are subjected to unsymmetrical loading.

The form modules are provided with tongue and-groove arrangements at the edges, to allow the form modules to connect to one another in horizontal and vertical directions. One example of a form module has overall dimensions of 12 inches ×11 inches ×48 inches (H ×W ×L). The thinner cross sections of the panels are approximately 2-½ inches thick and the combined wall panel/rib areas are approximately 4 inches thick and 5 inches wide. The groove on the edges of the module is approximately one inch wide and the tongue is approximately one inch deep, dimensioned to fit tightly within the groove. In the first embodiment, the tie mechanism is made of a molded plastic construction, preferably an ABS plastic, and the tie can be readily reconfigured for form modules of different widths.

Figure 37:
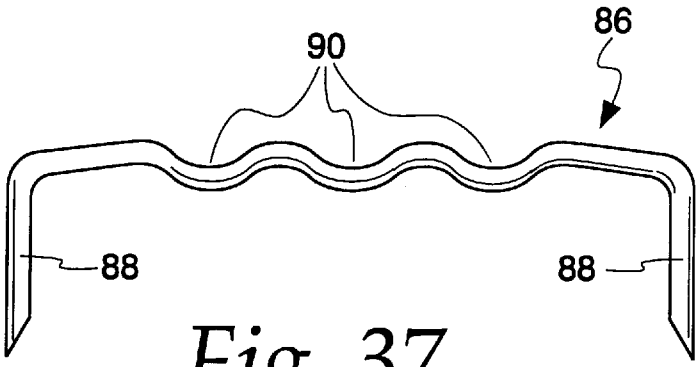
FIG. 37 is a front elevational view of a support member.

Referring to FIGS. 7–12, the form modules 10 are delivered to a building site and an initial course of form modules is erected, the modules being stacked one along side of the other. If desired, vertical reinforcing bars or the like can be provided, and anchored to a footing prior to installation of the form modules. Horizontally extending reinforcing bars or other structural members may then be positioned with respect to form modules previously installed. If desired, the support members 86, shown in FIG. 37, may be added for this purpose.

Figure 39:
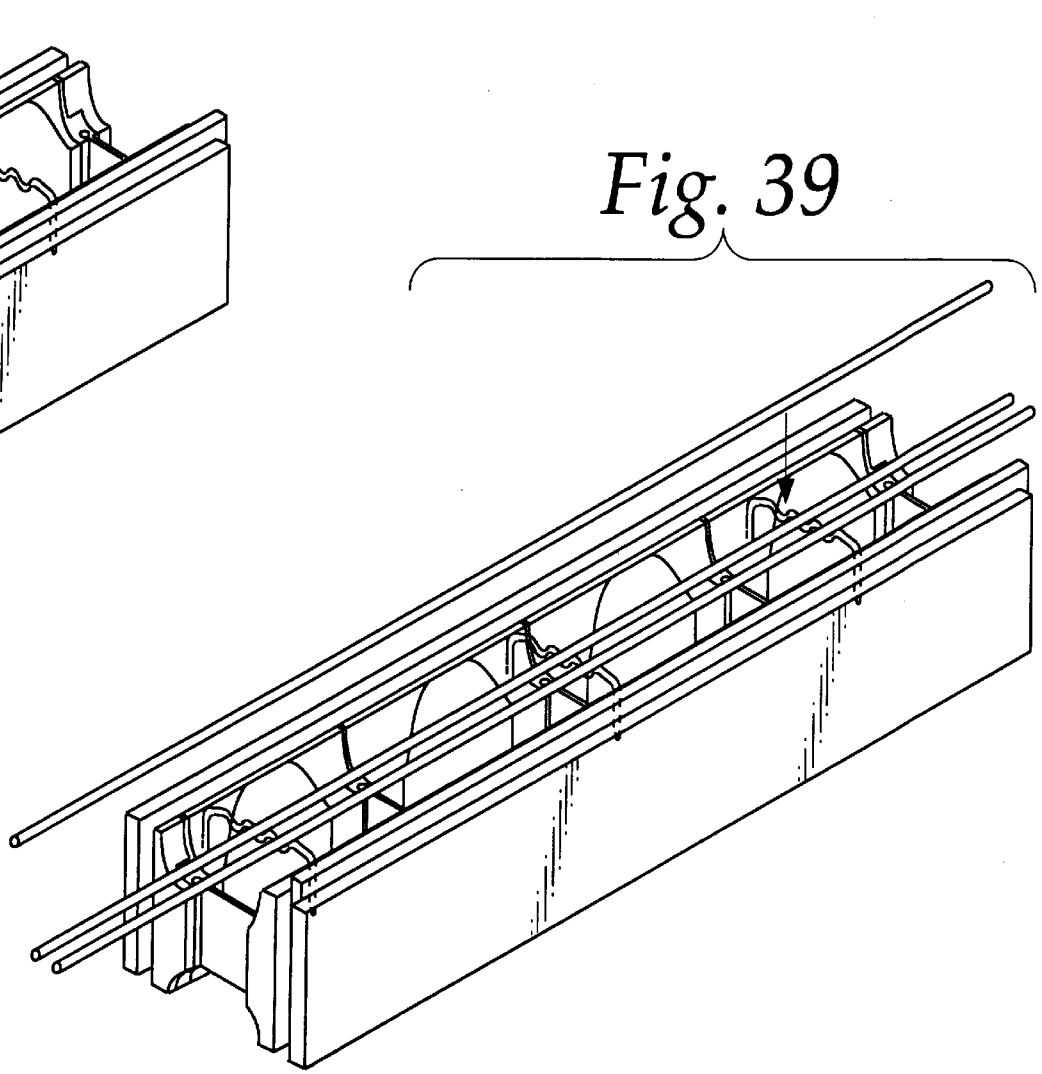
FIG. 39 is a perspective view showing reinforcing bars being installed in the form module of FIG. 38.
Figure 38:
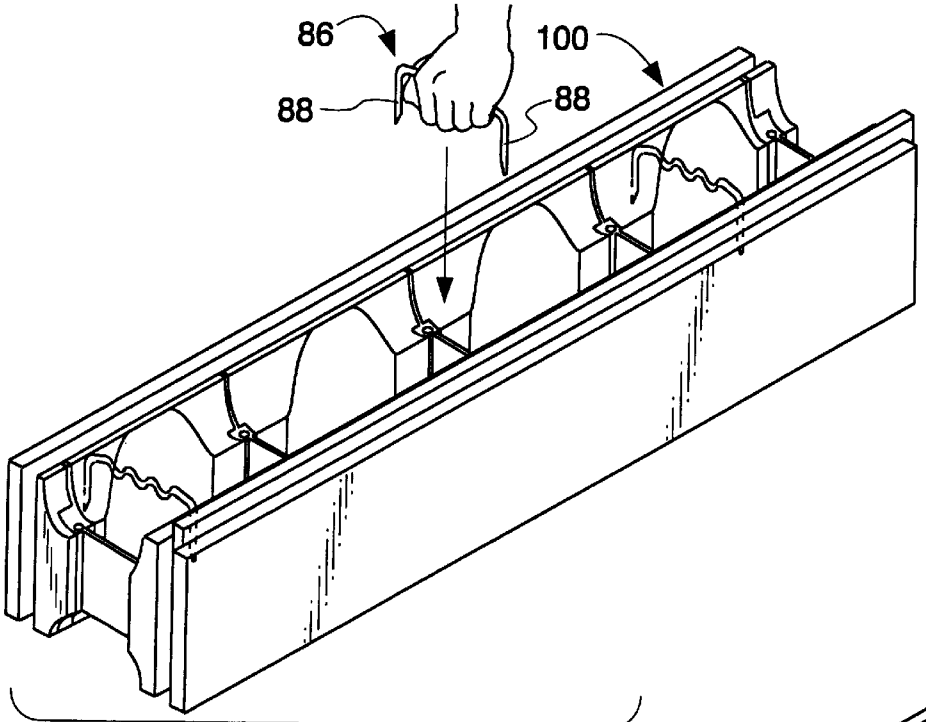
FIG. 38 is a perspective view showing installation of the support member of FIG. 37 in a form module.

The supports 86 are preferably made of the same material as the tie members, and as will be seen herein, a variety of materials are used for this purpose. However, it is generally preferred that the support members 86 be made of a non-metallic plastic or plastic-filled material. In use, the barbed ends 88 of the supports 86 are pressed into the upper ends of form modules 12, spanning the distance between opposing ribs of the form module panels. The grooves 90 help cradle the horizontal reinforcing bars in position, speeding the joinder of adjacent rebars, according to local codes and building practices. An arrangement of reinforcing bars and supports 86 is shown in FIGS. 38 and 39. Additional courses of form modules are then added to attain a desired height for the building structure.

Referring to FIGS. 7 and 11, it can be seen that a hollow interior is defined by the form modules 10. The hollow interior has enlarged cells or cavity portions 94 spaced apart by the narrowed or reduced cavity portions 92 located between opposing ribs. Concrete, sand, rock or other flowable building material is poured into the cavities and is allowed to descend vertically through the cavities, spreading out laterally, by passing through the apertures 34 in the tie members. It will be noted that the cavity portions 92 nearest the tie members are of reduced size, and compared to the large cavity portions 94, flow velocities of poured material, especially concrete mixtures, will increase, aiding in a thorough "wetting" of the web members and exposed stabilizing plate surfaces, eliminating the risk of forming voids in those regions.

As mentioned, the present invention has found immediate application in the construction of concrete walls. The concrete poured into the form module is flowable, and preferably has a consistency sufficient to quickly fill the lowest courses of the form modules. Further, the poured material spreads out in a lateral or horizontal direction to quickly and completely fill the lower course of form modules. Additional material is added according to local building codes and construction practices. For example, the rate of pour of concrete is usually set at four feet per hour for this purpose, assuming standardized atmospheric conditions. The pour rate is, of course, adjusted for varying climatic conditions, most important of which are temperature and humidity. As mentioned, much faster pore rates are possible with form modules according to the present invention. In any event, the concrete portion which first settles in the form system is the first to begin a conventional setting or hardening process. Initially, the concrete imparts an outward pressure to the form modules, which resembles a fluid pressure. However, as the concrete sets this outward pressure is reduced, and the lower portions of the concrete pour help to support the upper portions.

As can be seen herein, the tie members perform a variety of functions throughout the life history of a form module. The tie members shown and described herein are preferred, in part, because of the cost savings of their construction. For example, as indicated in FIG. 3, the thickness of the web portions is uniform throughout, and is approximately equal to the thickness of the stabilizing plates, as well as the end portions of the bearing plates. This simplifies the molding process, and results in cost savings to the form module manufacturer. Further, it is believed that a wider variety of plastics materials can be used in such a plastic mold. Further, if desired, the same plastic mold can be used to produce the internal tie members shown in FIG. 3 and the external tie members shown in FIG. 6, by using conventional plug members in the plastic mold. As can be seen in FIGS. 13–21, the end parts of the alternative tie member construction are more complex, from a plastic molding perspective. However, given the nature of the tie member end parts, plastic molding costs have been minimized without sacrificing performance of the resulting tie member assemblies.

Turning now to FIGS. 13–39, a second embodiment of a form module and its component members will now be described. The completed form module indicated by reference numeral 100 is shown, for example, in FIGS. 31–35 and, as can be seen herein, bears certain resemblance to the form module 10 described above. For example, the form module 100 includes wall panels 112, 114 having respective wall portions 116 and 118 and respective rib portions 120, 122. As can be seen, for example, in FIG. 33, tongue members 124 and groove members 126 alternate at the ends of the wall panels 112, 114.

Figure 33:
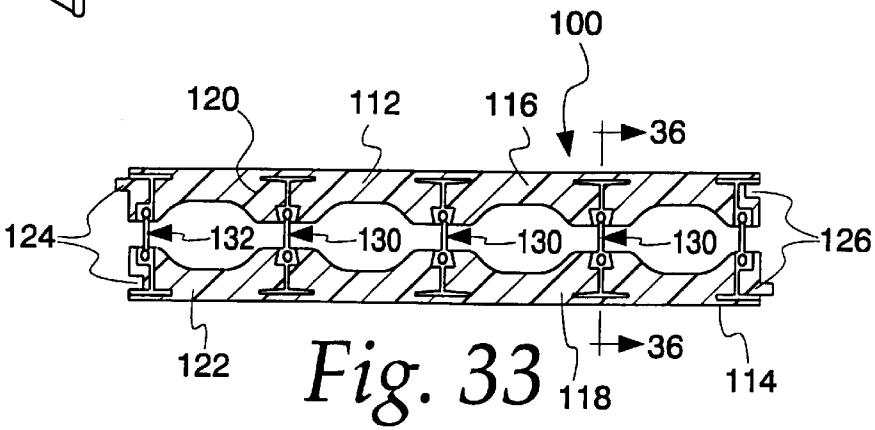
FIG. 33 is a cross-sectional view taken along the line 33—33 of FIG. 32.
Figure 32:
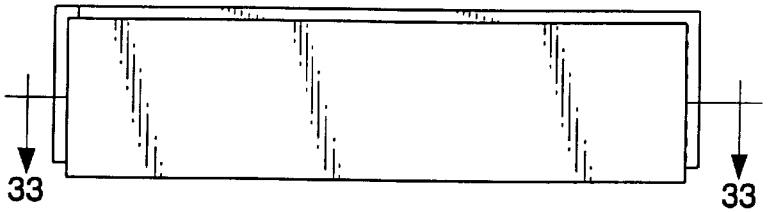
FIG. 32 is a front elevational view of a completed form module.
Figure 34:
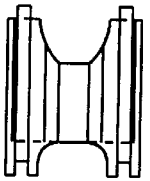
FIG. 34 is an elevational view taken from one end of the module of FIG. 32.
Figure 35:
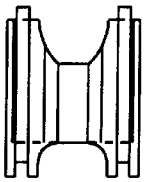
FIG. 35 is an elevational view taken from the other end of the module of FIG. 32.

As will be seen herein, unlike the tie members described above, the tie members used in the form module 100 are not monolithic, but are formed from an assembly of a small number of components. As with the preceding embodiment, the tie members shown in FIG. 33 are partially embedded within the panels 112, 114. The internal tie members are identified by reference numeral 130, whereas the external tie members are indicated by the reference numeral 132.

Figure 36:
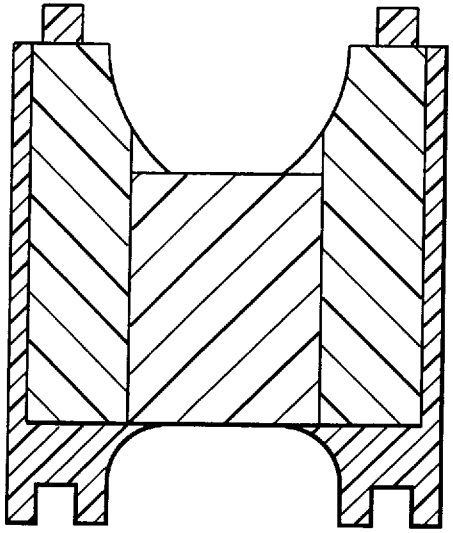
FIG. 36 is a cross-sectional view taken along the line 36—36 of FIG. 33.

Referring to FIG. 36, the internal tie members 130 include end portions 134, whereas the external tie members 132 have end portions 136, 138 which are mirror images of one another. The end portions 134, 136 are embedded within the panels, as indicated for example in FIG. 31. An identical complement of end portions 134, 136 are embedded in the opposing panel 114 and, thus, economies of fabrication are realized.

Figure 27:
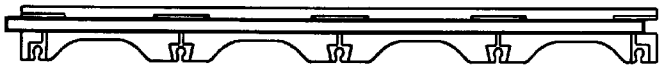
FIG. 27 is a top plan view thereof.
Figure 28:
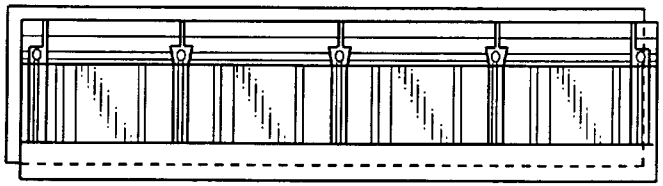
FIG. 28 is a front elevational view thereof.
Figure 29:
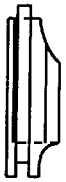
FIG. 29 is an elevational view form one end thereof.
Figure 30:
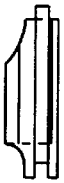
FIG. 30 is an elevational view from the other end thereof.
Figure 31:
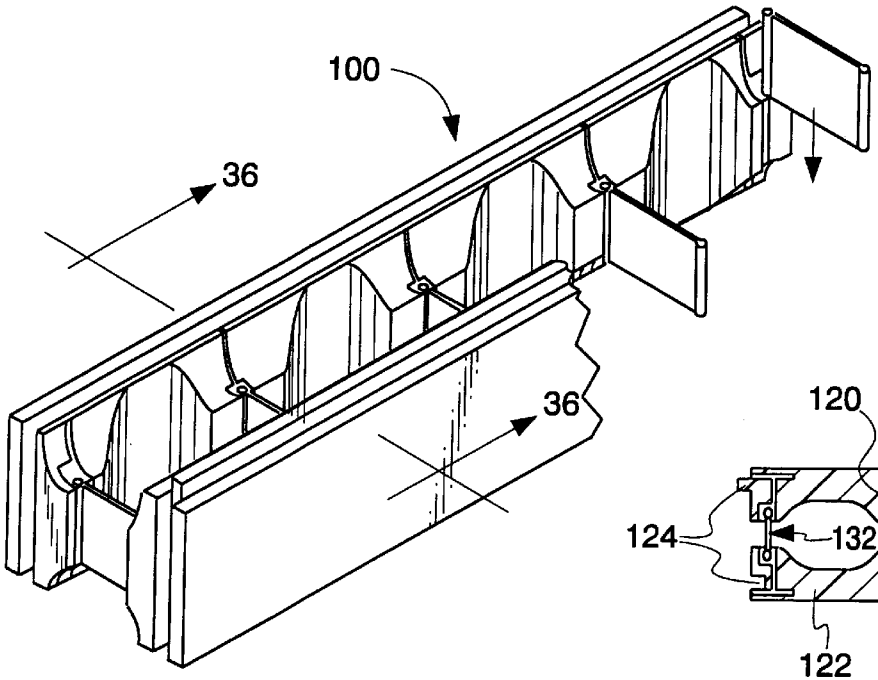
FIG. 31 is a perspective view of the form module, shown partly broken away.

Referring again to FIG. 36, a wall panel 112 is formed by loading end portions 134, 136 in the plastic molding form, and thereafter injecting the plastic foam material to surround the end members 134, 136, producing the panel construction shown, for example, in FIG. 27.

Figure 25:
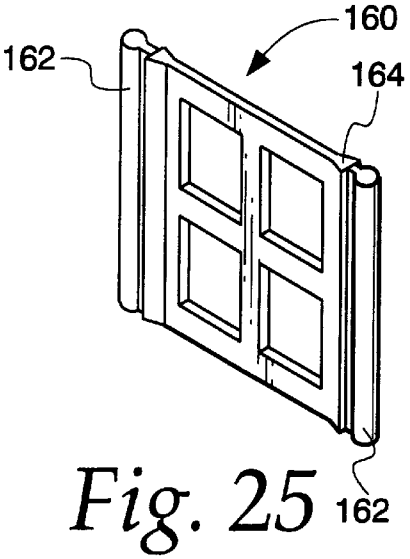
FIG. 25 shows an alternative embodiment of the middle component of FIG. 22.
Figure 22:
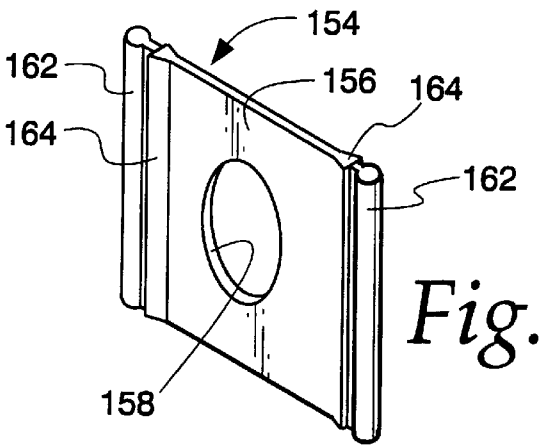
FIG. 22 is a perspective view of a middle component used in conjunction with the tie components of FIGS. 13–21 to form an alternative tie assembly.
Figure 23:
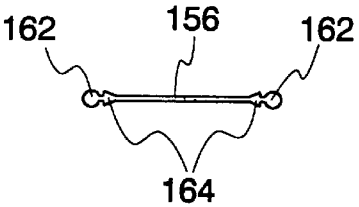
FIG. 23 is a top plan view thereof.
Figure 24:
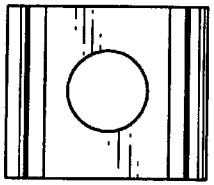
FIG. 24 is a front elevational view thereof.
Figure 19:
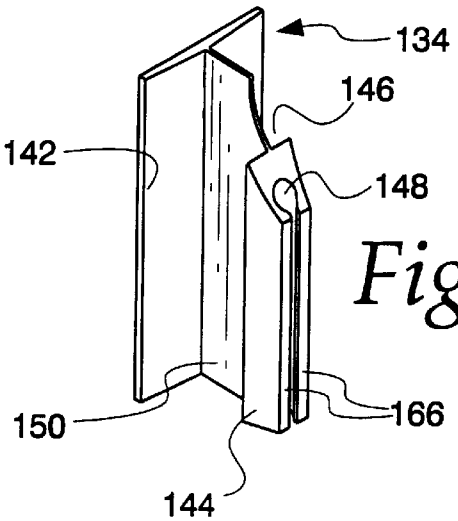
FIG. 19 is a perspective view of another tie component used in the alternative embodiment of the present invention.
Figure 20:
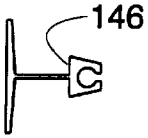
FIG. 20 is a top plan view thereof.
Figure 21:
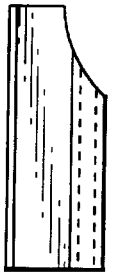
FIG. 21 is a front elevational view thereof.
Figure 26:
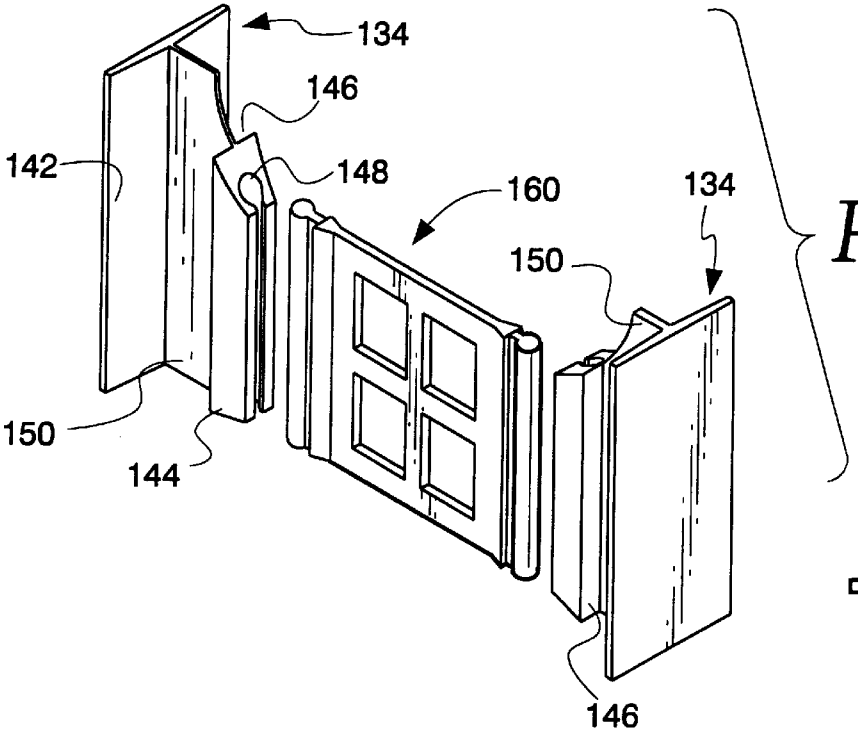
FIG. 26 is an exploded perspective view of an alternative tie member construction.

Referring to FIGS. 19–21, the end portions 134 of interior tie members are shown on an enlarged scale. End members 134 include a bearing plate 142 and an enlarged channel portion 144 having a stabilizing surface 146 and an open groove 148 formed therein. As with the preceding embodiment, the bearing plate 142 is embedded within the panel 112 and the bearing surface 146 is also embedded in the panel, but located adjacent, and preferably extending from the interior surface of the panel rib members. The stabilizing surface 146 functions in the manner similar to the stabilizing plates of the preceding embodiment. A web member 150 joins the bearing plate 142 to the channel member 144. FIGS. 22–24 show a first embodiment of a web member which is utilized for the end members 134 as well as the end members 136 and 138. The web member 154 includes a medial plate-like portion 156 in which an opening 158 is formed. Alternatively, as shown in FIG. 25, the web member 160 may be provided, with an open matrix configuration. Alternatively, the web member may have a solid central plate-like portion.

Returning again to FIGS. 22–25, the web members 154, 160 have enlarged, part cylindrical ends 162 dimensioned to be received in the open grooves 148 of end members 134. The web members include enlarged reinforcing portions 164 which are generally triangular shaped in cross section. Referring to FIG. 19, the opening to groove 148 is formed by a pair of opposed edge portions 166. These edge portions 166 are received between the enlarged cylindrical edge portions 162 and the enlarged triangular reinforcing portions 164 of the web members, as shown in the Figures. In practice, the edges of the web members are slidingly received in the open grooves 148. For example, the web members 154 may be slidingly inserted from above, as suggested in the upper corner of FIG. 31.

Referring now to FIGS. 13–18, the exterior end portions 136, 138 are shown on an enlarged scale. As can be seen, the exterior members 136, 138 are mirror images of one another. The enlarged post-like channel members 144 of the end members 136, 138 are, however, offset to one side of the interconnecting web members 150, unlike the end member 134. As a further difference, the bearing plates 170, 172 of the end members 136, 138 are truncated in a manner similar to that of the preceding embodiment.

In practice, opposed pairs of wall panels are provided at the job site, and preferably a selection of web members of different widths are also provided. Depending upon the wall thickness desired, the desired size web members are selected and slidingly inserted into opposed pairs of panels to complete the form module 100 shown, for example, in FIG. 31. Thereafter, supports 86 may be added in the manner indicated in FIG. 38, with barbed ends 88 piercing the ribs of the opposed panels. As can be seen, for example, in FIG. 38, the upper ends of the various tie members are exposed in the complete form module 100, thereby adding to the compression strength of the form module, as well as the ability of the form module to sustain abrasive wear.

The form modules according to the present invention have found immediate commercial acceptance for use with conventional concrete mixtures used by the building trades. However, other applications of the form modules are also possible. For example, materials other than concrete can be employed. Temporary walls or sound deadening walls can be readily made by pouring sand into the form modules. Further, specialty walls can be constructed. For example, a radiation shield can be quickly and easily erected by pouring suitable moderator material into the form modules. Further, the form modules have applications outside of the building industry. For example, sand or rock or earth filled form modules could be used to contain a hazardous material spill. It will be appreciated that the form modules can be quickly and easily dismantled and disposed of using conventional treatments for items which have come in contact with hazardous materials, such as incineration.

As indicated above, it is preferred that the tie members be located at points of localized thickening of the foam wall panels, i.e., they are located at the rib members formed in the foam wall panels. If desired, the tie members can be located without regard to the relative thickness of the wall portion, as long as the working surface of the stabilizing members face the bearing plates located near the outside of the foam wall portion, and the working surface of the stabilizing member is in contact with an inner surface of the foam wall partition.

In the preferred embodiment shown herein, the wall partitions are generally coextensive, are spaced apart and are generally parallel to one another, although this is not necessary to practice the present invention. For example, a curved wall partition could be used in conjunction with a flat wall partition. As with the embodiment described herein, a plurality of tie members would be employed to connect the two wall partitions together. However, due to the dissimilar shape of the wall members, the tie members would be of different widths. As mentioned above, the embodiment of the present invention described in FIGS. 13 and following is particularly suitable for applications of this type.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A freestanding form module for receiving flowable materials to make a wall which includes the form module, the form module comprising:

at least two spaced-apart form members having opposed interior form surfaces, each form member including a wall portion and a rib portion extending from the wall portion toward another of said form members;

a series of tie members extending between the form members, the tie members comprising a pair of end parts, with a middle part between the end parts, the end parts and the middle part joined together in serial succession;

each tie member having opposed ends with a web member between the ends extending along a web axis, a bearing member at each end of the tie member, extending generally transverse to the web axis and embedded in a respective form member and each end of the tie member having a stabilizing member extending generally transverse to the web axis, spaced from the bearing member and embedded in the a respective form member adjacent the interior form surface thereof; and the tie members at the ends of the series have smaller bearing plates than the remaining tie members.

2. The freestanding form module of claim 1 wherein the bearing member comprises a plate.

3. The freestanding form module of claim 2 wherein the stabilizing member comprises a channel with an opening facing toward another of said form members and a stabilizing surface opposite the opening.

4. The freestanding form module of claim 3 wherein the middle part comprises a plate with enlarged ends received in the channel opening.

5. The freestanding form module of claim 4 wherein the channel opening is located adjacent the interior form surface.

* * * * *